US011138937B2

(12) United States Patent
Park et al.

(10) Patent No.: US 11,138,937 B2
(45) Date of Patent: Oct. 5, 2021

(54) DISPLAY DRIVING CIRCUIT, DISPLAY DEVICE INCLUDING THE SAME, AND METHOD OF OPERATING THE DISPLAY DRIVING CIRCUIT

(71) Applicant: SAMSUNG ELECTRONICS CO., LTD., Suwon-si (KR)

(72) Inventors: Unki Park, Suwon-si (KR); Minsik Kim, Seongnam-si (KR); Hyeonsu Park, Seoul (KR); Hyunwook Lim, Seoul (KR); Woohyuk Jang, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/829,244

(22) Filed: Mar. 25, 2020

(65) Prior Publication Data

US 2021/0012717 A1 Jan. 14, 2021

(30) Foreign Application Priority Data

Jul. 11, 2019 (KR) ..... 10-2019-0083950

(51) Int. Cl.
*G09G 3/3258* (2016.01)

(52) U.S. Cl.
CPC ... *G09G 3/3258* (2013.01); *G09G 2320/0633* (2013.01); *G09G 2354/00* (2013.01)

(58) Field of Classification Search
None
See application file for complete search history.

(56) References Cited

U.S. PATENT DOCUMENTS

2007/0296689 A1* 12/2007 Kimura ..... G09G 3/3426 345/102
2015/0116344 A1* 4/2015 Won ..... G09G 3/32 345/589
2016/0178835 A1* 6/2016 Kim ..... G02B 6/0083 362/612
2017/0336851 A1 11/2017 Bae et al.
2018/0129268 A1 5/2018 Lee et al.
2018/0248991 A1 8/2018 Ryu et al.
2018/0268777 A1 9/2018 Kim et al.
2018/0348846 A1 12/2018 Lee et al.
2019/0278967 A1* 9/2019 Shepelev ..... G09G 3/32

FOREIGN PATENT DOCUMENTS

CN 108494974 A 9/2018
CN 108650423 A 10/2018
CN 109256090 A 1/2019
KR 10-2019-0027495 3/2019

* cited by examiner

*Primary Examiner* — Aneeta Yodichkas
(74) *Attorney, Agent, or Firm* — Lee IP Law, PC

(57) ABSTRACT

A display driving circuit for driving a display panel includes a control logic that adjusts brightness of a first partial area by adjusting pixel data values included in partial image data to be displayed on the first partial area of the display panel based on received brightness control information, and a data driver that generates image signals by digital-analog conversion of pixel data values provided from the control logic, the data driver providing the image signals to the display panel.

15 Claims, 16 Drawing Sheets

DISPLAY DRIVING CIRCUIT, DISPLAY DEVICE INCLUDING THE SAME, AND METHOD OF OPERATING THE DISPLAY DRIVING CIRCUIT

CROSS-REFERENCE TO RELATED APPLICATION

Korean Patent Application No. 10-2019-0083950, filed on Jul. 11, 2019, in the Korean Intellectual Property Office, and entitled: "Display Driving Circuit, Display Device Including the Same, and Method of Operating the Display Driving Circuit," is incorporated by reference herein in its entirety.

BACKGROUND

1. Field

Embodiments relate to a semiconductor device, and more particularly, to a display driving circuit for driving a display panel so that an image is displayed on the display panel, a display device including the same, and a method of operating the display driving circuit.

2. Description of the Related Art

A display device may include a display panel for displaying an image and a display driving circuit for driving the display panel. The display driving circuit may drive the display panel by receiving image data from a processor and applying image signals corresponding to the received image data to a data line of the display panel. An organic light emitting diode (OLED) display panel may have a plurality of pixels in a pixel array, the pixels each including an OLED.

SUMMARY

Embodiments are directed to a display driving circuit for driving a display panel, the display driving circuit including a control logic that adjusts brightness of a first partial area by adjusting pixel data values included in partial image data to be displayed on the first partial area of the display panel based on received brightness control information, and a data driver that generates image signals by digital-analog conversion of pixel data values provided from the control logic, the data driver providing the image signals to the display panel.

Embodiments are also directed to a display device, including a display panel including at least one partial area, and a display driving circuit that adjusts partial image data to be displayed on the at least one partial area of the display panel based on brightness control information for changing brightness of the display panel, and controls brightness of the at least one partial area by displaying the adjusted partial image data in the partial area when an operation mode changes from a first operation mode to a second operation mode.

Embodiments are also directed to a method of operating a display driving circuit for controlling brightness of a partial area of a display panel, the method including receiving brightness control information from a processor, adjusting pixel data values corresponding to the partial area based on the brightness control information, and driving the partial area based on the adjusted pixel data values.

BRIEF DESCRIPTION OF THE DRAWINGS

Features will become apparent to those of skill in the art by describing in detail example embodiments with reference to the attached drawings in which.

DETAILED DESCRIPTION

Hereinafter, example embodiments are described in relation to the accompanying drawings.

Figure 1:
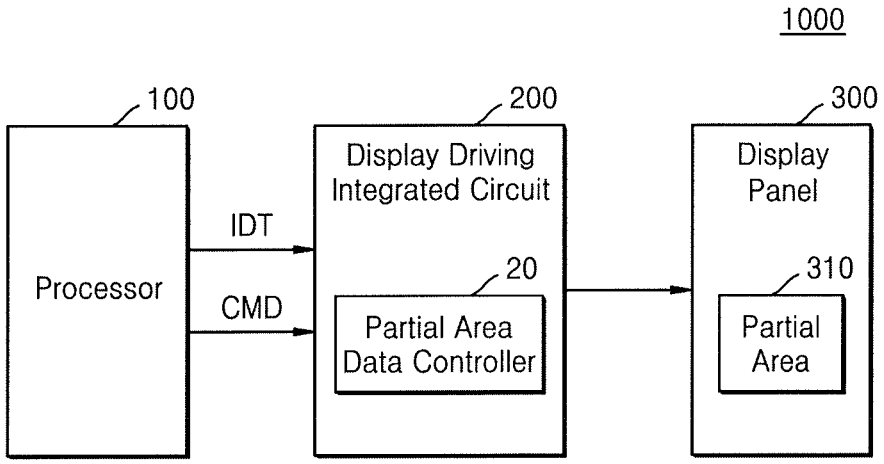
FIG. 1 illustrates a block diagram of a display system according to an example embodiment.

FIG. 1 is a block diagram illustrating a display system 1000 according to an example embodiment.

The display system 1000 according to the present example embodiment may be mounted in an electronic device having an image display function. For example, the electronic device may be a smartphone, a tablet personal computer (PC), a portable multimedia player (PMP), a camera, a wearable device, an Internet of things (IoT) device, a television set, a digital video disk (DVD) player, a refrigerator, an air conditioning system, an air cleaner, a set-top box, a robot, a drone, a medical device, a navigation device, a global positioning system (GPS) receiver, an advanced drivers assistance system (ADAS), a vehicle device, furniture, or a measurement device.

Referring to FIG. 1, the display system 1000 may include a processor 100, a display driving circuit 200 (or a display driving integrated circuit (IC)), and a display panel 300. The display driving circuit 200 may include a partial area data controller 20. In an example embodiment, the display driving circuit 200 and the display panel 300 may be implemented as one module and the module may be referred to as a display device.

The processor 100 may control, for example, entirely control, the display system 1000. The processor 100 may generate image data IDT to be displayed on the display panel 300, and may transmit the image data IDT and a control command CMD to the display driving circuit 200. The processor 100 may be, for example, a graphics processor or various kinds of processors such as a central processing unit (CPU), a microprocessor, a multimedia processor, or an application processor (AP). In an example embodiment, the processor 100 may be implemented by an integrated circuit (IC), a mobile AP, or a system on chip (SoC).

The display panel 300 is a display unit on which an image is displayed, and may be a display device that receives an electrically transmitted image signal and displays a two-dimensional image, such as a thin film transistor-liquid crystal display (TFT-LCD), an organic light emitting diode (OLED) display, a field emission display, or a plasma display panel (PDP). In an example embodiment, the display panel 300 may be an OLED display panel in which each of pixels includes an OLED. In other embodiments, the display panel 300 may be implemented by another kind of flat panel display or a flexible display panel.

The display driving circuit 200 may display the image on the display panel 300 by converting the image data IDT received from the processor 100 into image signals for driving the display panel 300 and supplying the image signals to the display panel 300.

The display driving circuit 200 may include the partial area data controller 20. In accordance with an operation mode of the display driving circuit 200, the image may be displayed on at least one partial area 310 of the display panel 300.

The partial area 310 does not refer to a singular fixed area of the display panel 300 as, on the display panel 300, a position and size of the partial area 310 and the number of partial areas 310 may change in accordance with time or a driving condition. In one example, the partial area 310 may be one area in which an image of a previously set format is displayed when the display system 1000 operates in a low power mode (or a low brightness mode), and may be referred to as an always-on display (AOD) area.

The partial area data controller 20 may control brightness of the partial area 310. The partial area data controller 20 may maintain the brightness of the partial area 310 or may change the brightness of the partial area 310 to a desired value by adjusting pixel data values of pixels corresponding to the partial area 310, that is, pixel data values included in the image data to be displayed on the partial area 310 (or the pixel data values in units of prescribed units). Hereinafter, the image data displayed on the partial area 310 will be referred to as partial image data.

In an example embodiment, when brightness setup of the display panel 300 is changed or brightness control of another area on the display panel 300 affects the brightness of the partial area 310, considering an expected brightness change amount, by adjusting data values of the image data to be displayed on the partial area 310, the partial area data controller 20 may maintain the brightness of the partial area 310 or may change the brightness of the partial area 310 into the desired value.

For example, when it is expected that the brightness of the partial area 310 is increased by a change in brightness setup of the display panel 300 or the brightness control of another area on the display panel 300, the partial area data controller 20 may prevent the brightness of the partial area 310 from increasing by reducing the data values of the partial image data so that the brightness of the partial area 310 is reduced.

In an example embodiment, the partial area data controller 20 may control the brightness of the partial area 310 based on sensing information received from the processor 100 or an external sensor, for example, sensing data. For example, when the received sensing information represents that a user is not near or not approaching, or movement of a user is not sensed, the partial area data controller 20 may adjust the data value of the partial image data so that the brightness of the partial area 310 is reduced.

In an example embodiment, the partial area data controller 20 may adjust at least partial pixel data values of the partial image data to be displayed on the partial area 310 based on user selection, for example, a user selection signal USS received from the processor 100. For example, the partial area data controller 20 may adjust pixel data values of the partial image data so that the brightness of the partial area 310 is increased or reduced in accordance with time based on the user setup. In another example embodiment, the partial area data controller 20 may adjust the pixel data values of the partial image data so that brightness corresponding to at least one color (for example, at least one of red, green, and blue) of partial pixels (for example, one of a background and contents of the partial image data in which the back ground and the contents are combined and displayed) of the partial image data is selectively increased or reduced based on the user selection.

In another example embodiment, the partial area data controller 20 may adjust the pixel data values by determining a reference scaling value based on received brightness control information, and scaling the pixel data values of the partial image data based on the reference scaling value.

In another example embodiment, the partial area data controller 20 may adjust the reference scaling value based on loading effect, mura defect of the display panel 300, and voltage drop (IR-drop) in accordance with a position or size of the partial area 310 on the display panel 300, and may adjust the pixel data values of the partial image data based on the adjusted reference scaling value. The partial area data controller 20 may reflect an offset value by pixel while adjusting the pixel data values.

Figure 2:
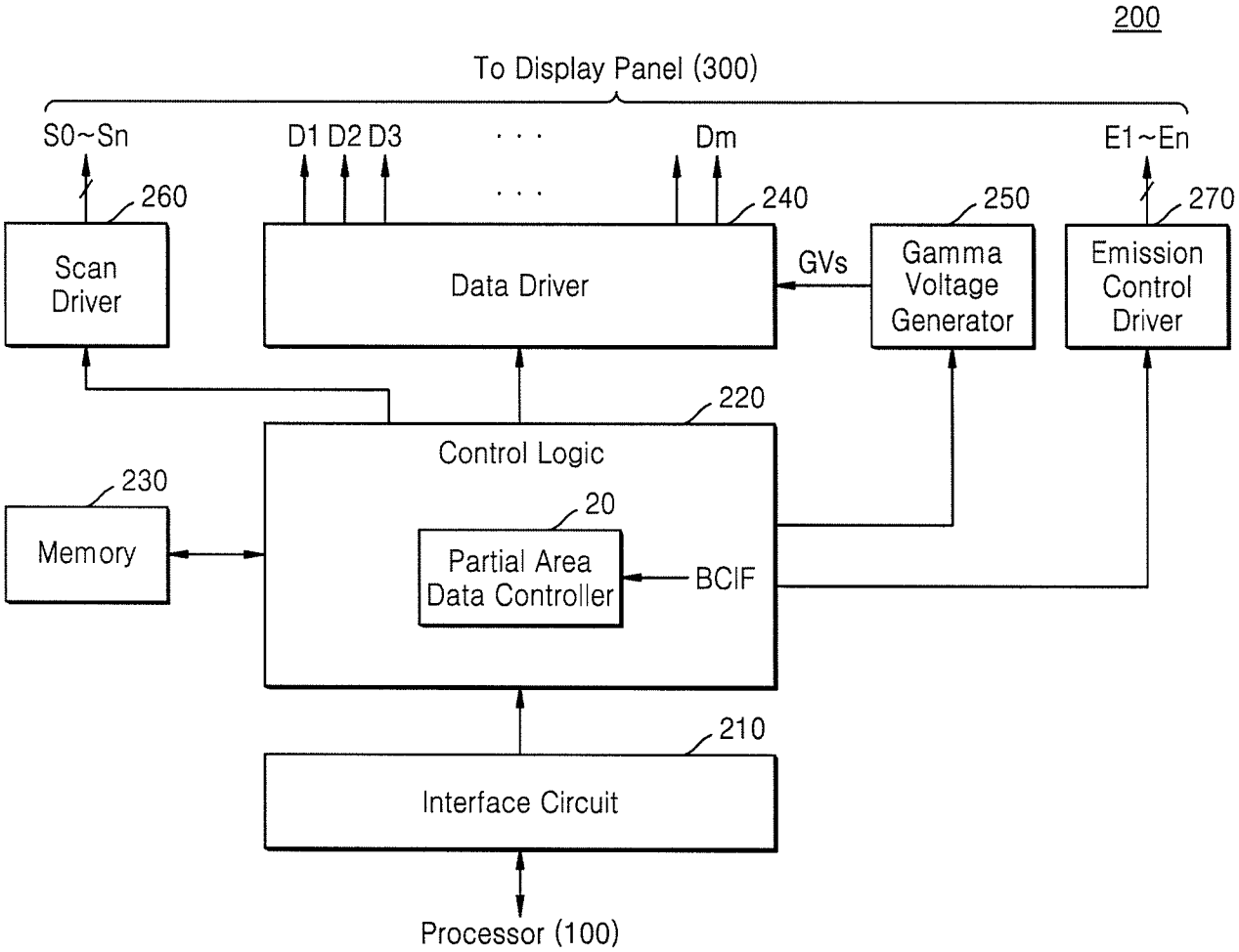
FIG. 2 illustrates a block diagram of a display driving circuit according to an example embodiment.

FIG. 2 is a block diagram illustrating the display driving circuit 200 according to an example embodiment.

Referring to FIG. 2, the display driving circuit 200 may include an interface circuit 210, a control logic 220, a memory 230, a data driver 240, a gamma voltage generator 250, a scan driver 260, and an emission control driver 270. In an example embodiment, the interface circuit 210, the control logic 220, the memory 230, the data driver 240, the gamma voltage generator 250, the scan driver 260, and the emission control driver 270 may be integrated in one semiconductor chip. In another implementation, the interface circuit 210, the control logic 220, the memory 230, the data driver 240, and the gamma voltage generator 250 may be formed in one semiconductor chip and the scan driver 260 and the emission control driver 270 may be formed in the display panel (300 of FIG. 1). The display panel 300 may be formed, for example, through a low temperature poly-silicon (LTPS) process after forming an amorphous silicon layer on a glass substrate and performing. A thin film transistor (TFT) of the display panel 300 (i.e., LTPS display panel) may have a high response speed and uniformity. A plurality of transistors may be formed by using poly-silicon formed by an LTPS process, and the scan driver 260 and the emission control driver 270 may be formed on the display panel 300 by using the plurality of transistors.

The interface circuit 210 may interface with signals or data transmitted and received between the processor 100 and the display driving circuit 200. The interface circuit 210 may be implemented by one of serial interfaces such as a mobile industry processor interface (MIPI), a mobile display digital interface (MDDI), a display port, and an embedded display port (eDP).

The control logic 220 may control operation, for example, an entire operation, of the display driving circuit 200, and may control components of the display driving circuit 200, for example, the interface circuit 210, the memory 230, the data driver 240, the gamma voltage generator 250, the scan driver 260, and the emission control driver 270, such that image data received from a processor is displayed on the display panel 300. In addition, the control logic 220 may perform image processing on the received image data in order to change brightness, a size, and a format, or may generate new image data to be displayed on the display panel 300 based on the received image data. As described above with reference to FIG. 1, the partial area data controller 20 may be implemented as a part of the control logic 220. In another implementation, the partial area data controller 20 may be implemented by a logic circuit separate from the control logic 220.

The memory 230 may store the image data received from the processor 100 in units of frames. The memory 230 may be referred to as graphic random access memory (RAM)) or a frame buffer. The memory 230 may include volatile memory such as dynamic random access memory (DRAM) or static random access memory (SRAM) or non-volatile memory such as read only memory (ROM), flash memory, resistive random access memory (ReRAM), or magnetic random access memory (MRAM).

In an example embodiment, symbol image data (for example, stereotyped numbers, characters, and special characters) or partial image frames including stereotyped images such as a time screen and a date screen, which are received from the processor 100, may be stored in the memory 230 and may be used for generating the partial image data to be displayed on the partial area (310 of FIG. 1) in a first operation mode, for example, an AOD operation mode. In an implementation, the display driving circuit 200 may include memory that is physically separate from the memory 230, for example, symbol memory and the symbol image data or the partial image frames may be stored in the symbol memory.

The control logic 220 may provide the image data stored in the memory 230 or the image data received from the interface circuit 210 to the data driver 240 in units of line data, that is, in units of pixel data corresponding to one horizontal line of the display panel 300. The data driver 240 may include a plurality of decoders for converting received data into the image signals based on a plurality of gamma voltage GVs (also referred to as grayscale voltages) received from the gamma voltage generator 250 and a plurality of amplifiers respectively connected to the plurality of decoders, may convert the line data into a plurality of image signals D1 to Dm (m is an integer of no less than 2), and may output the image signals D1 to Dm to the display panel 300.

The gamma voltage generator 250 may generate the plurality of gamma voltages GVs, for example, gamma voltages GVs of 256 grayscales based on a set gamma curve, and may provide the generated gamma voltages GVs to the data driver 240. The gamma voltage generator 250 may change the highest gamma voltage and/or the lowest gamma voltage under control of the control logic 220, for example, in accordance with a control register value and may change the gamma curve.

Operations of the data driver 240, the scan driver 260, and the emission control driver 270 will be described in further detail with reference to FIG. 3.

Figure 3:
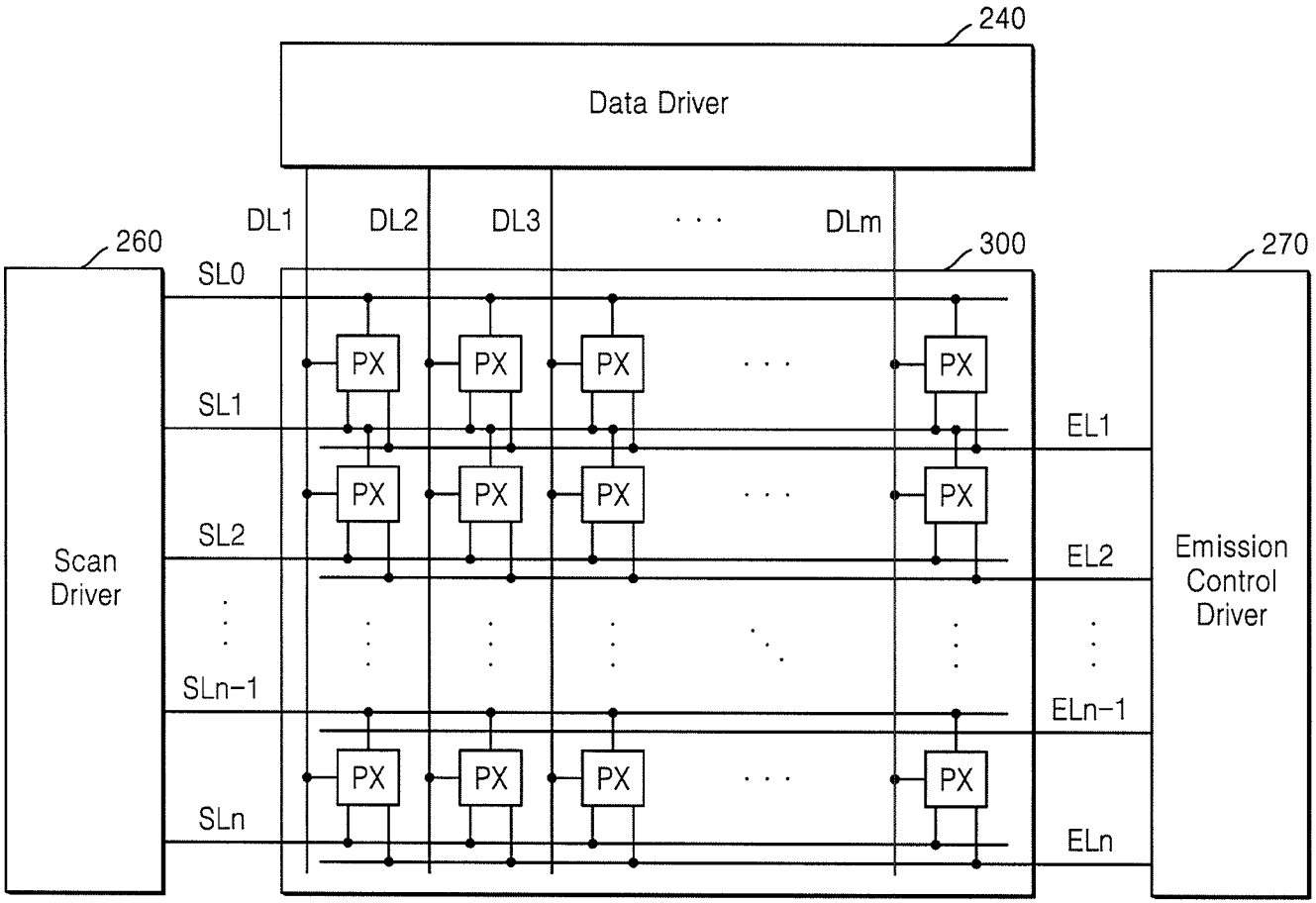
FIG. 3 illustrates a block diagram of the display panel of FIG. 1.

FIG. 3 is a block diagram illustrating the display panel 300 of FIG. 1. An OLED display panel will be described as an example of the display panel 300 and a method of driving the display panel 300 will also be described.

Referring to FIG. 3, the display panel 300 may include a plurality of data lines DL1 to DLm, a plurality of scan lines SL0 to SLn, a plurality of emission control lines EL1 to Eln, and a plurality of pixels PX arranged among the lines. The plurality of pixels PX may be respectively connected to the corresponding scan lines SL, data lines DL, and emission control lines EL.

The plurality of pixels PX may output light components of predetermined colors. Two or more pixels PX (for example, red, blue, and green pixels) that are arranged in the same line or adjacent lines and output light components of different colors may configure one unit pixel. The two or more pixels PX that configure the unit pixel may be referred to as sub-pixels. The display panel 300 may have an RGB structure in which the red, blue, and green pixels configure one unit pixel. In another implementation, the display panel 300 may have an RGBW structure in which the unit pixel further includes a white pixel for improving brightness. In another implementation, the unit pixel of the display panel 300 may be configured by a combination of pixels of other colors than the red, green, and blue colors.

In the present example embodiment, the scan driver 260 is connected to the plurality of scan lines SL0 and SL1 and sequentially selects the pixels PX by sequentially applying scan signals (S0~Sn of FIG. 2) to the pixels PX in units of lines.

In the present example embodiment, the emission control driver 270 is connected to the plurality of emission control lines EL1 to ELn and controls emission time of the pixels PX by sequentially applying the plurality of emission signals (E1~En of FIG. 2) via the control lines EL1 to ELn to the pixels PX.

The data driver 240 may generate the plurality of image signals (D1~Dm of FIG. 2) and may provide the plurality of image signals (D1~Dm of FIG. 2) to the pixels PX through the plurality of data lines DL1~DLm.

Figure 4A:
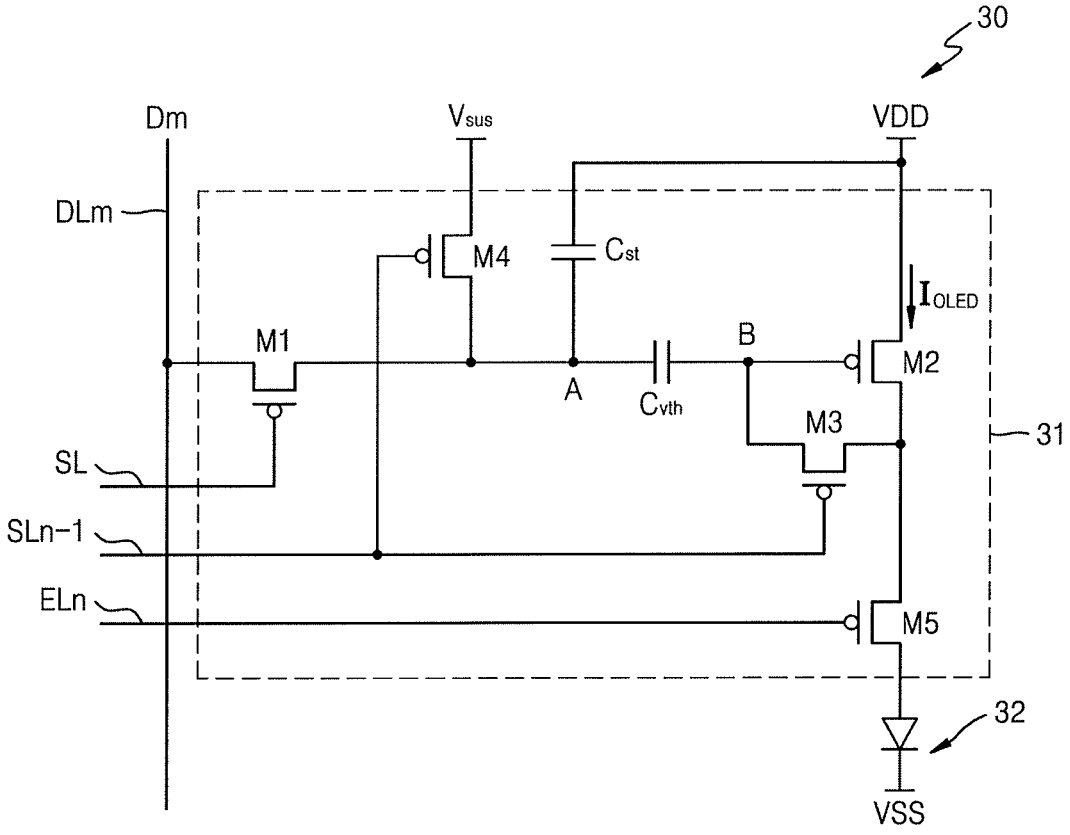
FIG. 4A illustrates a circuit diagram of a pixel of FIG. 3.

FIG. 4A is a circuit diagram illustrating an example of a pixel of FIG. 3.

Referring to FIG. 4A, the pixel 30 may include a pixel driver 31 and an OLED 32.

The pixel driver 31 may receive an image signal Dm, a previous scan signal Sn−1, a scan signal Sn, and an emission control signal En through the data line DLm, the previous scan line Sn−1, the scan line Sn, and the emission control line En and may receive a first power voltage VDD and a second power voltage Vsus. A driving current corresponding to the image signal Dm may be supplied from the first power voltage VDD to the OLED 32.

The OLED 32 may include an anode electrode, a cathode electrode, and an organic light emitting layer. The anode electrode may be connected to the pixel driver 31, and the cathode electrode may be connected to a ground voltage VSS. Therefore, the OLED 32 may receive the driving current supplied by the pixel driver 31 and may emit light with emission brightness corresponding to an amount of the driving current. For example, as illustrated in FIG. 4A, the pixel driver 31 may include first to fifth transistors M1 to M5 and two capacitors Cst and Cvth.

In the present example embodiment, a first electrode of a first transistor M1 is connected to the data line DLm, and a gate terminal thereof is connected to the scan line SLn. In addition, the first transistor M1 is turned on in response to the scan signal Sn transmitted through the scan line SLn and transmits the image signal Dm received through the data line DLm to the two capacitors Cst and Cvth.

The first power voltage VDD is applied to a first electrode of a second transistor M2, and a driving current $I_{OLED}$ corresponding to a voltage applied to a gate terminal of the second transistor M2, for example, the image signal Dm, may be generated. The second transistor M2 may be referred to as a driving transistor.

A third transistor M3 is connected between the gate terminal and a second electrode of the second transistor M2, is turned on by the scan signal Sn−1 applied to a gate terminal of the third transistor M3, which is connected to the previous scan line SLn−1, and compensates for a threshold voltage Vth of the second transistor M2, that is, the driving transistor.

The first capacitor Cvth is connected between the second electrode of the first transistor M1 and the gate terminal of the second transistor M2 and stores the threshold voltage Vth of the second transistor M2.

The second capacitor Cst is connected between the first power voltage VDD and one terminal of the first capacitor Cvth and may store the image signal Dm transmitted through the data line DLm.

A first electrode of a fourth transistor M4 is connected to the second power voltage Vsus, and a second electrode thereof is commonly connected to the first capacitor Cvth and the second capacitor Cst. The fourth transistor M4, to which the second power voltage Vsus is applied, is turned on by the previous scan signal Sn−1 applied to a gate terminal of the fourth transistor M4 and applies the second power voltage Vsus to the first capacitor Cvth and the second capacitor Cst.

A fifth transistor M5 is connected between the second electrode of the second transistor M2 and an anode electrode of the OLED 32 and may control emission time of the OLED 32 by performing on/off operations in accordance with control of the emission control signal En applied to a gate terminal of the fifth transistor M5 and supplying the driving current supplied by the second transistor M2 to the OLED 32 or blocking supply of the driving current supplied by the second transistor M2 to the OLED 32.

It will be understood that the pixel 30 illustrated with reference to FIG. 4A is merely an example, and a structure of the pixel 30 may vary.

An operation of the pixel 30 will be illustrated with reference to FIG. 4B.

Figure 4B:
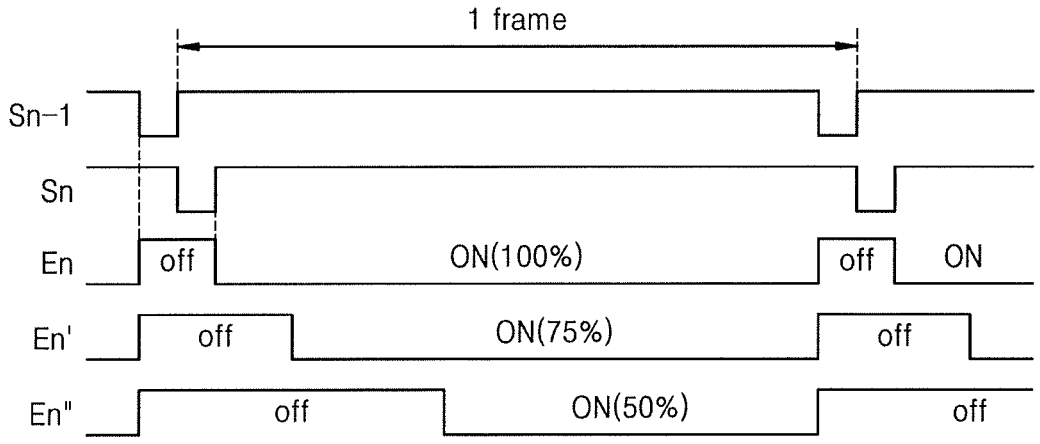
FIG. 4B illustrates a timing diagram of a pixel of FIG. 4A.

FIG. 4B is a timing diagram illustrating the pixel 30 of FIG. 4A.

In the present example embodiment, when the low level previous scan signal Sn−1 and the high level scan signal Sn (or referred to as current scan signal) and emission control signal En are applied to the pixel 30, the third transistor M3 and the fourth transistor M4 are turned on and the remaining transistors M1 and M5 are turned off. Therefore, the second transistor M2, that is, the driving transistor, is diode-connected and accordingly, a voltage VDD−|Vth| is applied to one electrode B of the first capacitor Cvth and the fourth transistor M4 is turned on, and, accordingly, the second power voltage Vsus is applied to the other electrode A of the first capacitor Cvth. Therefore, a voltage corresponding to Vsus−VDD+|Vth| may be stored in the first capacitor Cvth.

Next, when the low level scan signal Sn and the high level previous scan signal Sn−1 and emission control signal En are applied to the pixel 30, only the first transistor M1 is turned on. The image signal Dm is applied from the data line DLm to the other electrode A of the first capacitor Cvth through the first transistor M1. Therefore, in the other electrode A of the first capacitor Cvth, a voltage change (ΔV=Vsus−Vdata, where Vdata is a voltage of the image signal Dm) of a certain voltage difference occurs and accordingly, in the one electrode B of the first capacitor Cvth, a voltage change of the certain voltage difference occurs. Therefore, a voltage applied to the one electrode B of the first capacitor Cvth and the gate terminal of the second transistor M2 is VDD−|Vth|−ΔV=VDD−|Vth|−Vsus+Vdata.

Finally, the high level previous scan signal Sn−1 and scan signal Sn and the low level emission control signal En are applied to the pixel 30, and only the fifth transistor M5 is turned on.

The driving current $I_{OLED}$ output from the second transistor M2 is illustrated in EQUATION 1 as follows.

$$\begin{aligned} I_{OLED} &= k \times (Vsg - |Vth|)^2 \\ &= k \times \{VDD - (VDD - |Vth| - Vsus + Vdata) - |Vth|\}^2 \\ &= k \times (Vsus - Vdata)^2 \end{aligned} \quad \text{EQUATION 1}$$

wherein Vth represents the threshold voltage of the second transistor M2, Vsg represents a source-gate voltage of the second transistor M2, and k represents a coefficient.

As illustrated in EQUATION 1, in the pixel 30 illustrated in FIG. 4A, the driving current $I_{OLED}$ is not affected by changes in the threshold voltage Vth and the first power voltage VDD.

When the previous scan signal Sn−1 and the scan signal Sn are applied in one frame, an emission control signal of which a duty ratio varies in accordance with each brightness value may be represented. Thus, FIG. 4B illustrates the time at which pixels emit light components, that is, the emission control signal En with duty of 100%, an emission control signal En' with duty of 75%, and an emission control signal En" with duty of 50%.

First, the emission control signal En with duty of 100% emits light for almost one frame and displays high brightness by being converted to have a low level immediately after the scan signal Sn to turn on the fifth transistor M5, that is, an emission control transistor.

The emission control signal En' with duty of 75% emits light for about 75% of one frame and reduces brightness by about 25% by being converted to have a low level after certain time after the scan signal Sn to turn on the fifth transistor M5.

Next, only about 50% of the emission control signal En" with duty of 50% is converted to have a low level and reduces brightness to about half.

As described above, the emission control driver 270 may control the brightness of the display panel 300 by controlling emission duty, for example, by pulse width modulation (PWM), of the emission control signal En under control of the control logic 220.

Figure 5:
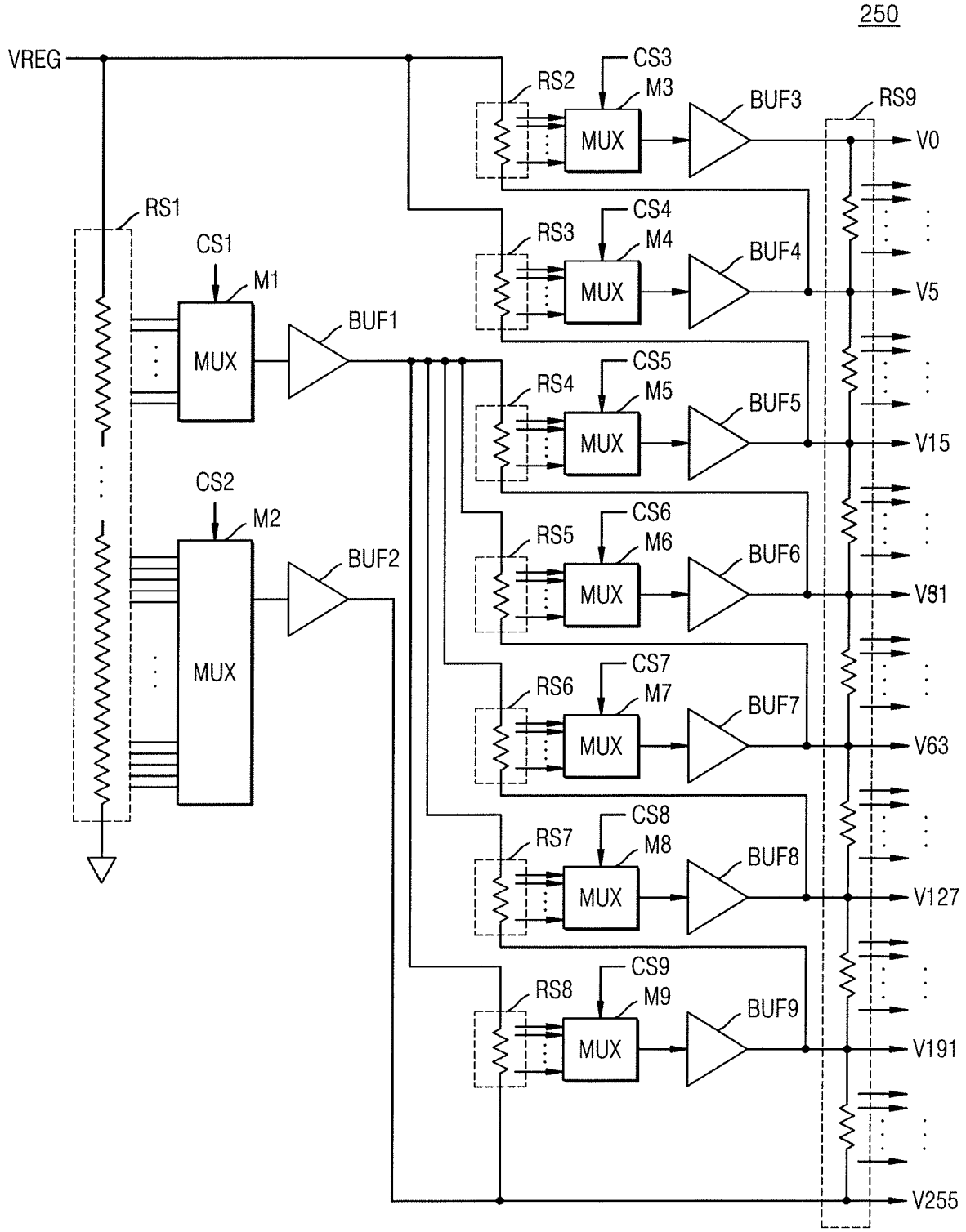
FIG. 5 illustrates a circuit diagram of a gamma voltage generator of FIG. 3.

FIG. 5 is a circuit diagram illustrating an implementation example of the gamma voltage generator of FIG. 3.

Referring to FIG. 5, the gamma voltage generator 250 may include a plurality of resistance strings RS1 to RS9, a plurality of selectors (for example, multiplexers) M1 to M9, and a plurality of buffers BUF1 to BUF9. The numbers of resistance strings RS1 to RS9, selectors (for example, multiplexers) M1 to M9, and buffers BUF1 to BUF9 may vary.

The plurality of resistance strings RS1 to RS9 may distribute a voltage applied to both ends by using resistors and may output a plurality of voltages. Each of the plurality of selectors M1 to M9 may select and output one of the voltages output from the corresponding resistance strings RS1 to RS9 based on received selection signals CS1 to CS9. The plurality of buffers BUF1 to BUF9 may buffer and output the voltages output from the corresponding selectors M1~M9. Therefore, a plurality of grayscale voltages, for example, the first to $256^{th}$ gamma voltages V0 to V255, may be generated.

The gamma curve may be varied in accordance with the selection signals CS1 to CS9 applied to the plurality of selectors M1~M9. For example, a level, for example, V255 of the minimum gamma voltage varies in accordance with the second selection signal CS2 and a level, for example, V0 of the maximum gamma voltage varies in accordance with the third selection signal CS3. In addition, in accordance with the first selection signal CS1 and the fourth to ninth selection signals CS4 to CS9, levels, for example, V5, V15, V31, V63, and V191 of the gamma voltages (which form inflection points of the gamma curve) may vary. When the gamma curve changes, since the levels V0 to V255 of the gamma voltages in accordance with the respective grayscales vary, brightness may change.

Figure 6A:
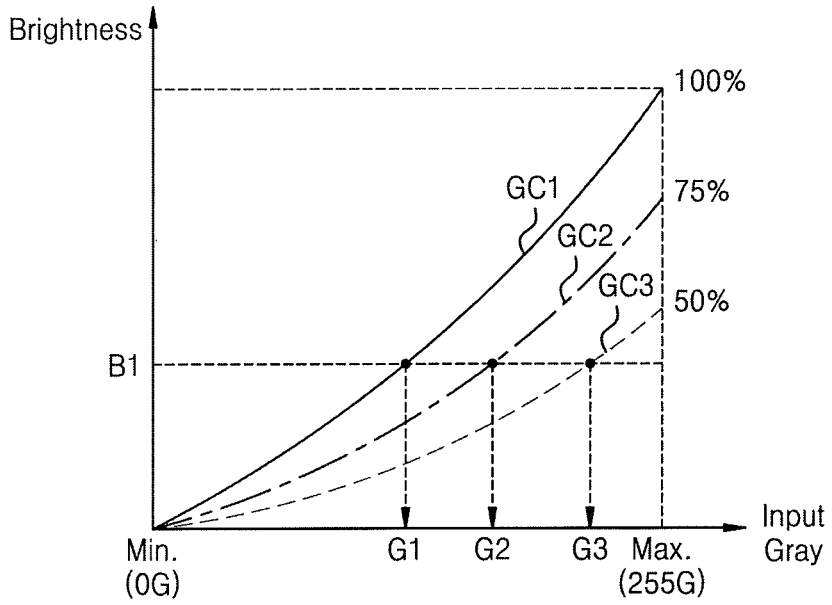
FIG. 6A illustrates a brightness change in accordance with adjustment of a gamma curve and FIG. 6B illustrates a brightness change in accordance with adjustment of a pixel data value.
Figure 6B:
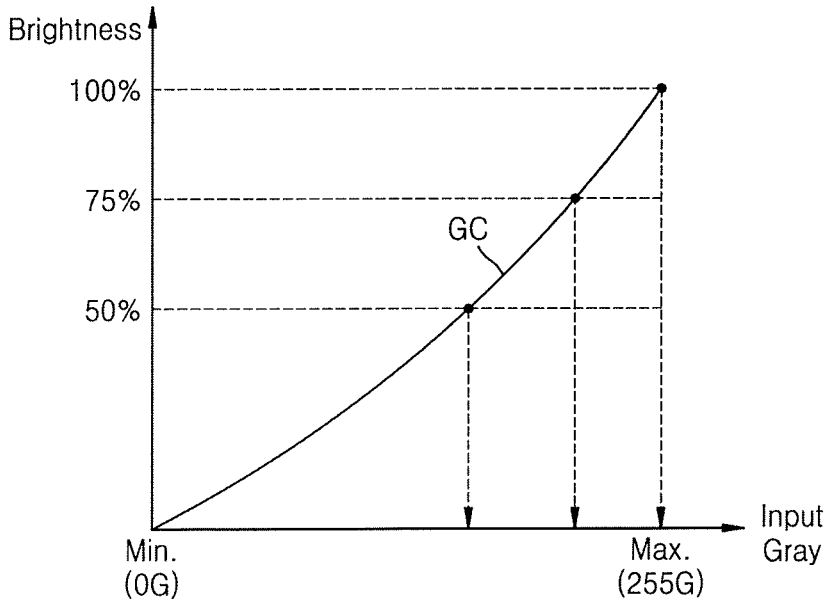

FIG. 6A illustrates a brightness change in accordance with adjustment of a gamma curve and FIG. 6B illustrates a brightness change in accordance with adjustment of a pixel data value. The horizontal axis represents grayscale and the vertical axis represents brightness.

Referring to FIG. 6A, in first to third gamma curves GC1 to GC3, brightness components in accordance with the level of the maximum gamma voltage (for example, 255 grayscale 255G) vary. Also, brightness components in accordance with the same grayscale (for example, G1, G2, G3) may vary. In detail, as compared to the maximum brightness of the first gamma curve GC1, the second gamma curve GC2 may have a maximum brightness of 75% and the third gamma curve GC3 may have a maximum brightness of about 50%. Therefore, when the gamma curve changes, the brightness of the display panel 300 may change.

On the other hand, as shown in FIG. 6A, the first to third gamma curves GC1 to GC3 have different grayscale values corresponding to a same brightness B1 of an optical signal output by a pixel. For example, when a change from the first gamma curve GC1 to the third gamma curve GC3 is made, in order for the pixel to output light with the same brightness (for example, light with the brightness B1), grayscale data (that is, input grayscale of the pixel) needs to be adjusted from G1 to G3. In addition, when a change from the first gamma curve GC1 to the second gamma curve GC2 is made, in order for the pixel to output light with the same brightness (for example, light with the brightness B1), the grayscale data of the pixel needs to be adjusted from G1 to G2.

Referring to FIG. 6B, when the grayscale (that is, the input grayscale of the pixel) is reduced based on the same gamma curve GC, the brightness is reduced and, when the input grayscale of the pixel is increased, the brightness is increased. Therefore, the brightness of the pixel may be changed by adjusting the pixel data value that represents the grayscale of the pixel.

As illustrated in FIG. 6A, a method of adjusting the brightness by changing the gamma curve may be referred to as a gamma control method. As illustrated in FIG. 6B, a method of adjusting the brightness by changing the pixel grayscale by adjusting the pixel data value may be referred to as a data adjustment method. In addition, as illustrated in FIG. 4B, a method of adjusting the brightness by changing a duty ratio of the emission control signal may be referred to as an adaptive impulse driving (AID) method.

Using the gamma control method and the AID method, the brightness of the display panel 300 may be changed. For example, in a low power mode in which the display panel 300 has a low brightness, the AID method may be used for controlling the brightness. In a normal display mode in which the display panel 300 has a high brightness, the gamma control method may be used for controlling the brightness. In another implementation, the AID method and the gamma control method may be simultaneously applied.

Using the gamma control method and/or the AID method, the brightness of the display panel 300 (for example, the entire display area of the display panel) may be controlled. Using the data adjustment method, brightness of the partial area 310 (for example, a subset or less than the entire display area of the display panel) may be changed by adjusting the pixel data values of the pixels corresponding to the partial area of the display panel 300. As described above with reference to FIG. 1, the partial area data controller 20 of FIG. 1 may locally adjust the brightness of the partial area 310 on the display panel 300 by adjusting the pixel data values of the partial image data.

Figure 7A:
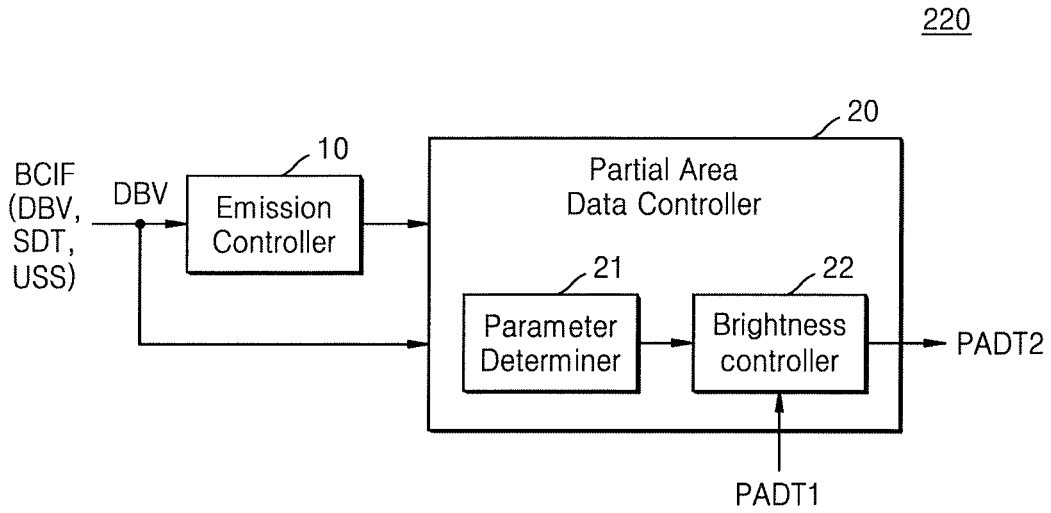
FIGS. 7A and 7B illustrate block diagrams of a control logic according to example embodiments.
Figure 7B:
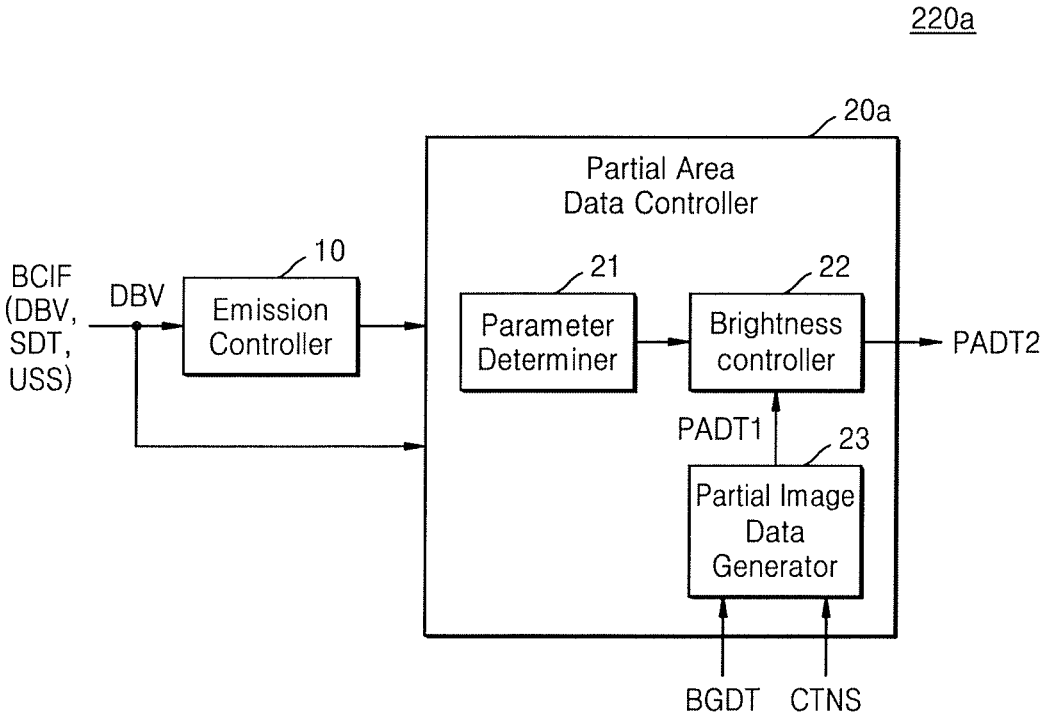

FIGS. 7A and 7B are block diagrams illustrating the control logic 220 according to example embodiments.

Referring to FIGS. 7A and 7B, the control logic 220 may include an emission controller 10 and the partial area data controller 20. The control logic 220 may further include other components for controlling the operation of the display driving circuit (200 of FIG. 1), for example, a memory controller and a timing controller.

Referring to FIG. 7A, the partial area data controller 20 may include a parameter determiner 21 and a brightness controller 22. In addition, as illustrated in FIG. 7B, the partial area data controller 20 may further include a partial image data generator 23.

Referring to FIG. 7A, the control logic 220 may receive brightness control information BCIF from, for example, the processor (100 of FIG. 1) or an external sensor. The brightness control information BCIF may include at least one of a brightness set value DBV (or a display brightness set value), sensing data SDT, and the user selection signal USS (or a control signal in accordance with user selection).

The brightness control information BCIF may be directly provided to the partial area data controller 20.

In another implementation, the brightness control information BCIF may be converted into emission information through the emission controller 10 and the emission information may be provided to the partial area data controller 20. For example, the emission controller 10 may determine the emission information (for example, a duty ratio based on the brightness set value DBV) and may provide the emission information to the partial area data controller 20. The emission information may be provided to the emission control driver (270 of FIG. 3) and the emission control driver 270 may adjust the brightness of the display panel 300 by controlling the emission time of the pixel PX based on the emission information.

The parameter determiner 21 may determine various parameters for displaying the partial image data on the partial area 310 of the display panel 300 based on the brightness control information BCIF.

In an example embodiment, the parameter determiner 21 may determine a parameter for adjusting the brightness of the display panel 300. As described above with reference to FIG. 1, the partial area data controller 20 may adjust the brightness of the partial area 310 by adjusting the pixel data values of the partial image data. Therefore, the parameter determiner 21 may determine a reference scaling value based on the brightness control information BCIF or the emission information received from the emission controller 10. The brightness controller 22 may generate adjusted or changed partial image data PADT2 by scaling pixel data values of partial image data PADT1 based on the reference scaling value. The changed partial image data PADT2 may be converted into the image signals through the data driver (240 of FIG. 2) and may be provided to the pixels of the partial area 310. The partial image data PADT1 may be, for example, the image data received from the processor 100 in real time or one of the partial image frames stored in the symbol memory as described in FIG. 2.

In an example embodiment, the parameter determiner 21 may determine the reference scaling value and the offset value by pixel based on the brightness control information BCIF and the emission information received from the emission controller 10.

For example, the parameter determiner 21 may include a lookup table in which reference scaling values and offset values by pixel that are set to correspond to the brightness control information BCIF (for example, various set values of the brightness set value DBV) are stored. In an example embodiment, the reference scaling values and the offset values by pixel may be experimentally determined based on a characteristic of the display panel 300 and may be stored in the lookup table. In an example embodiment, in an operation process of the display panel 300, the reference scaling values and the offset values by pixel may be updated.

The parameter determiner 21 may determine the reference scaling values and the offset values by pixel by accessing the lookup table based on the brightness control information BCIF or the emission information received from the emission controller 10.

In an example embodiment, the parameter determiner 21 may correct the reference scaling value based on the characteristic of the display panel 300. For example, the parameter determiner 21 may adjust or correct the reference scaling value considering at least one of the loading effect, the mura defect, and the voltage drop in accordance with the position or size of the partial area 310, and may determine the adjusted or corrected scaling value.

For example, when the position of the partial area 310 is remote from the data driver 240, since the loading effect and/or an amount of the voltage drop are greater than when the position of the partial area 310 is remote from the data driver 240, the brightness of the partial area 310 may be low. In addition, since the loading effect is greater when the size of the partial area 310 is large than when the size of the partial area 310 is small, the brightness of the partial area 310 may be low. The brightness of the partial area 310 may be controlled to be inversely proportional to the scaling value. Therefore, the parameter determiner 21 may reduce the reference scaling value when the position of the partial area 310 is remote from the data driver 240 or when the size of the partial area 310 is large.

In another example, the parameter determiner 21 may set reference scaling values for a plurality of blocks of the partial area 310 to be different from each other based on information on the mura defect (for example, the position of the mura defect) of the display panel 300. Therefore, the brightness of the partial area 310 may be uniform.

The brightness controller 22 may control the pixel data values for the partial image data PADT1 based on the scaling value determined by the parameter determiner 21, for example, the reference scaling value or the corrected scaling value and the offset value by pixel.

For example, the brightness controller 22 may generate the changed partial image data PADT2 by scaling the pixel data values based on the corrected scaling value, and adding the offset values respectively corresponding to the scaled pixel data values to the scaled pixel data values. The changed partial image data PADT2 may be converted into the image signals through the data driver (240 of FIG. 2) and may be provided to the pixels of the partial area 310.

Referring to FIG. 7B, the partial image data generator 23 may generate partial image data PADT1 based on background image data BGDT and contents image data CTNS. In an example embodiment, the symbol image data described with reference to FIG. 2 may be used as the contents image data CTNS. For example, the contents image data CTNS may be a clock screen that represents a date and time. The background image data BGDT may be received from the processor 100.

In an example embodiment, the processor 100 may provide the background image data BGDT and the contents image data CTNS in real time.

The partial image data generator 23 may generate the partial image data PADT1 to be displayed on the partial area 310 of the display panel 300 by synthesizing the contents image data CNTS with the background image data BGDT.

Brightness of the background image data BGDT may be set to be different from that of the contents image data CNTS based on the user selection signal USS. For example, when the user selection signal USS represents that brightness of the contents image data CNTS is set to be high, the parameter determiner 21 may set a reference scaling value applied to the contents image data CNTS to be less than a reference scaling value applied to the background image data BGDT.

Since the partial image data generator 23 internally generates the partial image data PADT1, the background image data BGDT may be distinguished from the contents image data CNTS by the partial image data PADT1. Therefore, the partial image data generator 23 may control the brightness of the background image data BGDT to be different from that of the contents image data CNTS based on the user selection signal USS in controlling the brightness of the partial image data PADT1.

Figure 8:
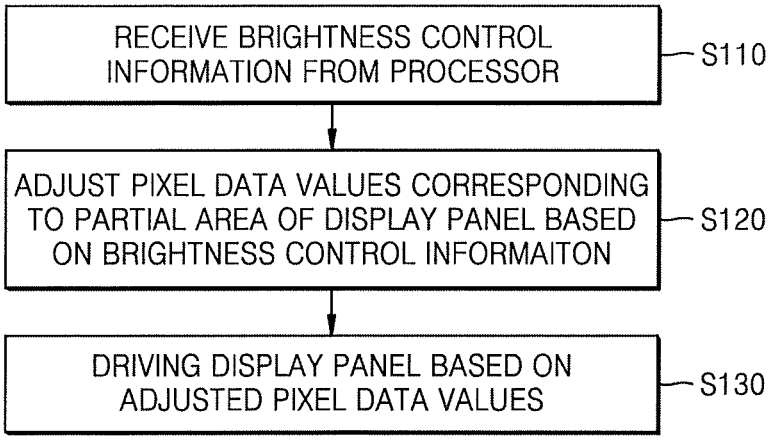
FIG. 8 illustrates a flowchart of a method of operating a display driving circuit according to an example embodiment.

FIG. 8 is a flowchart illustrating a method of operating a display driving circuit 200, according to an example embodiment. The operation method of FIG. 8 may be performed by the display driving circuit 200 of FIG. 1 and a method of compensating for the brightness of the above-described partial area may be applied to the current embodiment.

Referring to FIG. 8, the display driving circuit 200 may receive the brightness control information BCIF from the processor 100 in operation S110. The interface circuit (210 of FIG. 2) may receive the brightness control information BCIF and may provide the received brightness control information BCIF to the control logic (220 of FIG. 2). The brightness control information BCIF may include at least one of the brightness set value, the sensing data received from the external sensor, and the user selection signal USS.

The display driving circuit 200 may adjust the pixel data values corresponding to the partial area of the display panel based on the brightness control information BCIF in operation S120. The display panel 300 may include at least one partial area. The display driving circuit 200, in particular, the partial area data controller (20 of FIG. 1) may adjust the pixel data values of the partial area, that is, the partial image data to be displayed on the partial area based on the brightness control information BCIF.

The display driving circuit 200 may drive the display panel 300 based on the adjusted pixel data values in operation S130. The adjusted pixel data values may be converted into the image signals through the data driver and may be provided to the partial area of the display panel 300.

Figure 9:
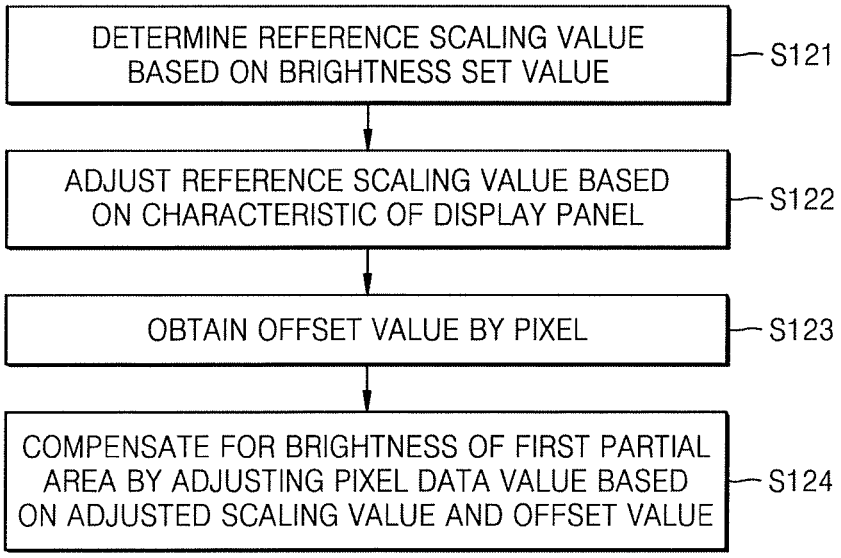
FIG. 9 illustrates a flowchart of a method of operating a display driving circuit according to an example embodiment.

FIG. 9 is a flowchart illustrating a method of operating a display driving circuit, according to an example embodiment. FIG. 9 illustrates an example process of adjusting the pixel data values of the partial area of FIG. 8, that is, operation S120.

Referring to FIG. 9, the display driving circuit 200, in particular, the parameter determiner (21 of FIG. 7A), may determine the reference scaling value based on the brightness set value in operation S121.

The parameter determiner 21 may correct the reference scaling value based on the characteristic of the display panel 300 in operation S122. The process of correcting the reference scaling value will be described with reference to FIG. 10.

Figure 10:
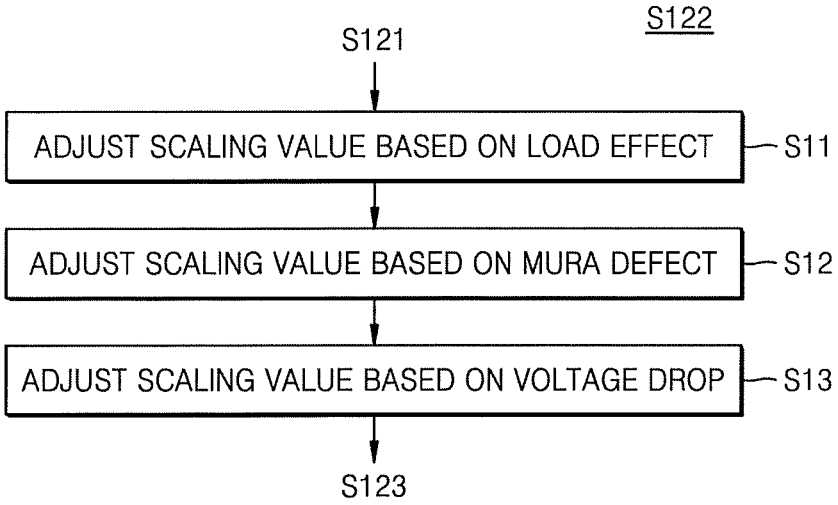
FIG. 10 illustrates a flowchart of an example of a reference scaling value correction process of FIG. 9.

FIG. 10 is a flowchart illustrating an example reference scaling value correction process of FIG. 9.

Referring to FIG. 10, the parameter determiner 21 may perform operation S11 of correcting the scaling value in accordance with the loading effect, operation S12 of correcting the scaling value based on the mura defect, and operation S13 of correcting the scaling value based on the voltage drop. In FIG. 10, it is illustrated that operation S11 of correcting the scaling value in accordance with the loading effect, operation S12 of correcting the scaling value based on the mura defect, and operation S13 of correcting the scaling value based on the voltage drop are sequentially performed. However, the order in which the above-described operations are performed may be varied, and one or more of operation S11 of correcting the scaling value in accordance with the loading effect, operation S12 of correcting the scaling value based on the mura defect, and operation S13 of correcting the scaling value based on the voltage drop may be omitted.

Referring to FIG. 9 again, the parameter determiner 21 may obtain the offset value by pixel in operation S123. As described with reference to FIG. 7A, the parameter determiner 21 (or the control logic) may include the lookup table that stores the reference scaling values and the offset values by pixel that correspond to the variable brightness set value DBV. In operations S121 and S123, the parameter determiner 21 may determine the reference scaling value based on the lookup table and may obtain the offset value by pixel.

The display driving circuit 200 may compensate for the brightness of the first partial area by adjusting the pixel data value based on the corrected scaling value and offset value in operation S124.

Figure 11:
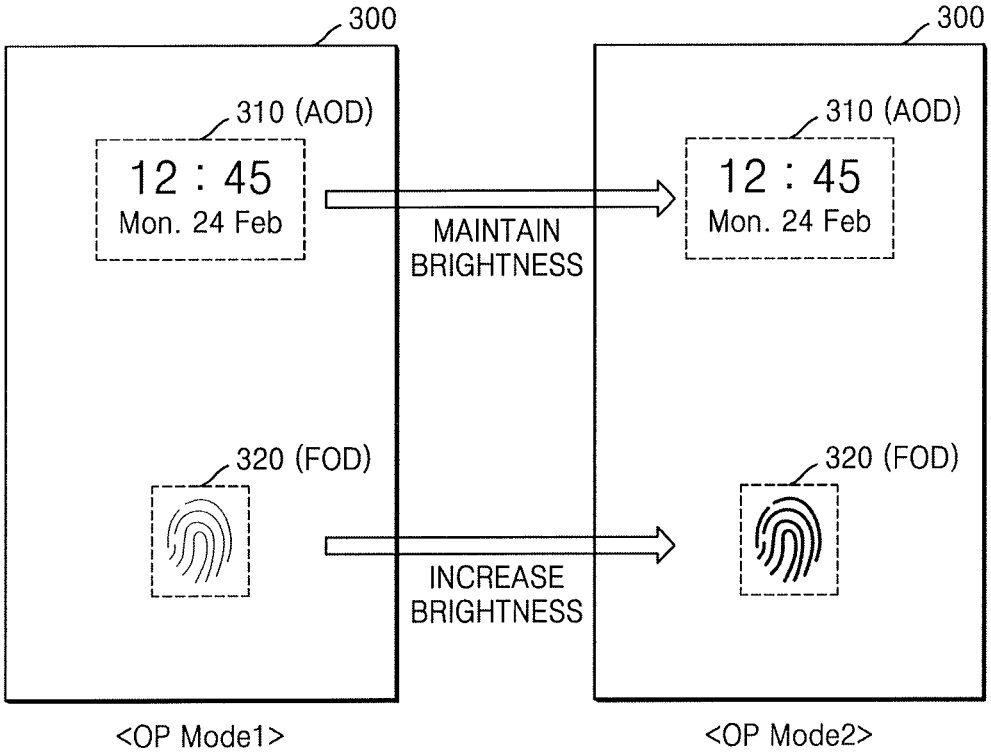
FIG. 11 illustrates a view of a method of compensating for brightness of a partial area using a display driving circuit according to an example embodiment.

FIG. 11 is a view illustrating a method of compensating for brightness of a partial area of a display driving circuit, according to an example embodiment.

Referring to FIG. 11, the first partial area 310 and a second partial area 320 may be arranged on the display panel 300. In the first operation mode, the first partial area 310 and the second partial area 320 may be displayed with low brightness. Then, in a second operation mode, the brightness of the display panel 300 may entirely increase for an operation to be performed by the second partial area 320. For example, the first operation mode may be the AOD mode and the second operation mode may be a fingerprint-on-display (FOD) mode in which a fingerprint is optically sensed on the display panel 300. The brightness of the second partial area 320 may be increased in order for the fingerprint to be optically sensed in the second partial area 320. For this purpose, the brightness set value may increase. Using the AID method or the gamma control method, the brightness of the display panel 300 may be increased.

At this time, in order for the first partial area 310 to maintain the same brightness in the first operation mode and the second operation mode, the partial area data controller (20 of FIG. 1) of the display driving circuit (200 of FIG. 1) may uniformly maintain the brightness of the first partial area 310 by adjusting the pixel data values of the partial image data to be displayed on the first partial area 310 based on the above-described data adjustment method.

If the brightness of the first partial area 310 increases in the second operation mode, power consumption may increase, a user may feel uneasy due to rapid increase in brightness, and flicker may occur, and the display panel 300 may deteriorate (for example, a burn-in phenomenon may occur). However, using the method of operating the display driving circuit according to an example embodiment, although an operation mode changes, the brightness of the first partial area 310 may be uniformly maintained. Therefore, it may be possible to minimize power consumption, prevent flicker from occurring, and to prevent the display panel 300 from deteriorating.

Figure 12:
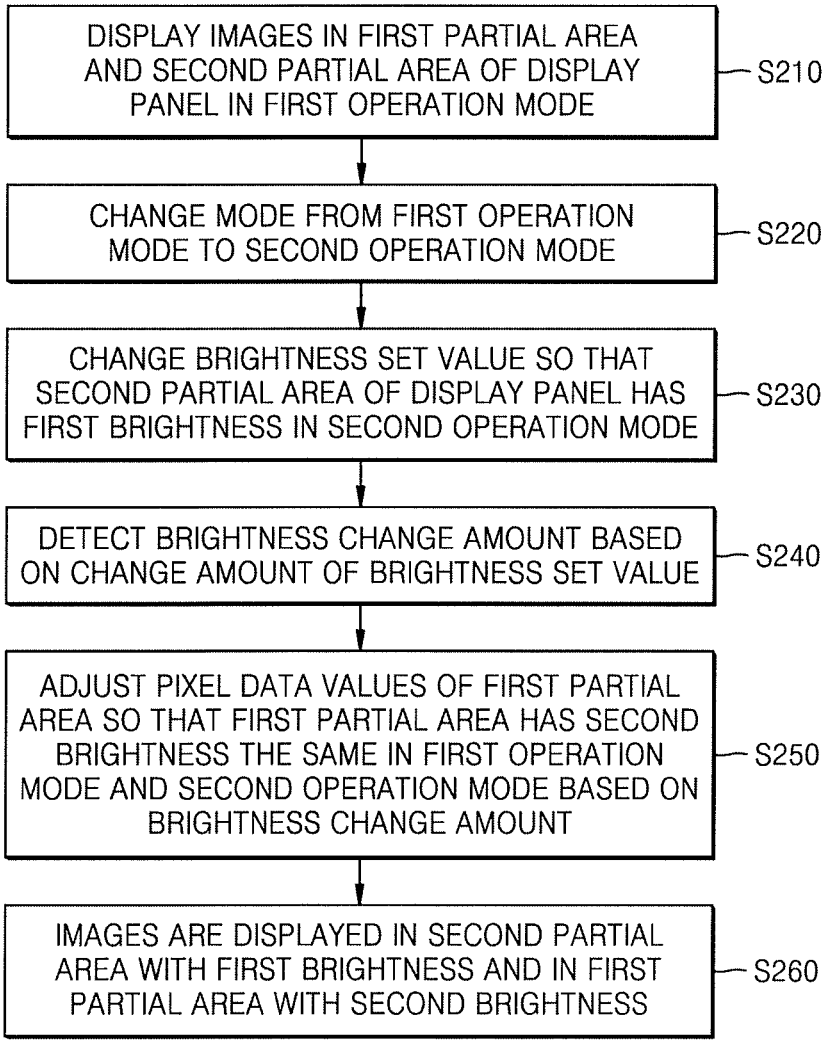
FIG. 12 illustrates a flowchart of a method of operating a display driving circuit according to an example embodiment.

FIG. 12 is a flowchart illustrating a method of operating a display driving circuit according to an example embodiment.

Referring to FIG. 12, in the first operation mode, images may be displayed on the first partial area and the second partial area of the display panel in operation S210. In an example embodiment, the images may be displayed on the first partial area and the second partial area of the display panel with a low brightness.

The operation mode of the display driving circuit may change from the first operation mode to the second operation mode in operation S220. For example, the first operation mode may be the AOD mode and the second operation mode may be the FOD mode. When a touch of a user or a proximate signal is detected on the display panel, the operation mode of the display driving circuit may change to the FOD mode and, in the second partial area, optical fingerprint sensing for user authentication may be performed.

In the second operation mode, the brightness set value may change so that the second partial area of the display panel has first brightness in operation S230. For example, the brightness set value of the display panel may change so that the second partial area is set to have the first brightness that is high brightness for fingerprint sensing.

The control logic (the partial area data controller) may detect an amount of change in the brightness based on an amount of change in the brightness set value in operation S240. The partial area data controller may detect the amount of change in the brightness between the first operation mode and the second operation mode based on an amount of change in the received brightness set value in operation S240.

The partial area data controller may adjust the pixel data value of the first partial area so that the first partial area maintains the same second brightness in the first operation mode and the second operation mode based on the amount of change in the brightness in operation S250.

In the second operation mode, the images may be displayed in the second partial area of the display panel with the first brightness and in the first partial area of the display panel with the second brightness in operation S260.

Figure 13:
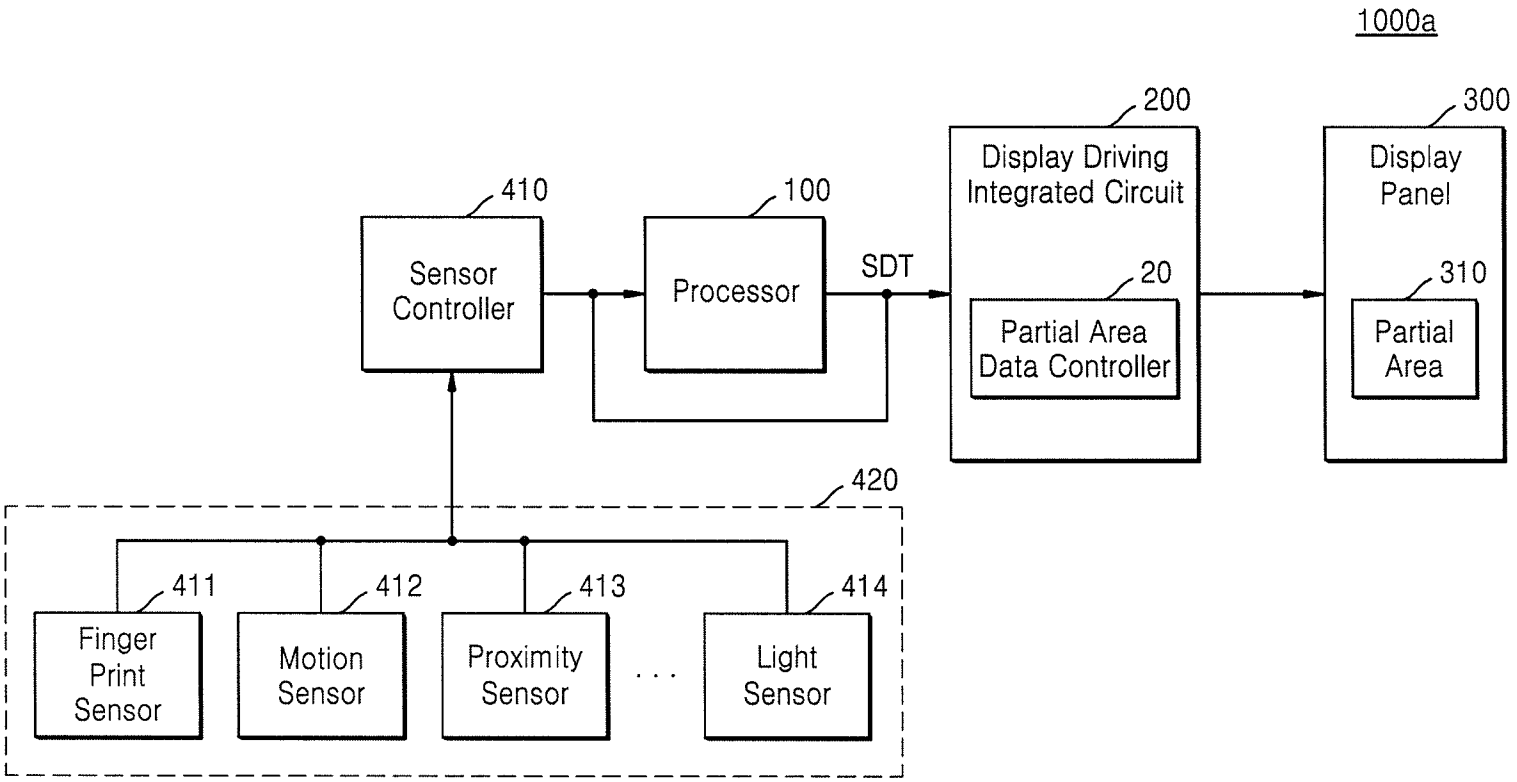
FIG. 13 illustrates a block diagram of a display system according to an example embodiment.

FIG. 13 is a block diagram illustrating a display system 1000*a* according to an example embodiment.

Referring to FIG. 13, the display system 1000*a* may include the processor 100, the display driving circuit 200, the display panel 300, a sensor controller 410, and a sensor module 420. In an example embodiment, the sensor controller 410 and the processor 100 may be mounted on a main board or the sensor controller 410 may be implemented as a part of the processor 100.

The sensor module 420 may include various sensors, for example, a fingerprint sensor 411, a motion sensor 412, a proximity sensor 413, and a light sensor 414. Sensors provided in the sensor module 420 may transmit sensing data SDT to the sensor controller 410.

The sensor controller 410 may provide the received sensing data SDT to the display driving circuit 200 through the processor 100 or may directly provide the received sensing data SDT to the display driving circuit 200. In an example embodiment, when the processor 100 operates in a low power mode, for example, a sleep mode, the sensor controller 410 may directly provide the sensing data SDT to the display driving circuit 200.

The partial area data controller 20 may adjust the brightness of the partial area 310 of the display panel 300 based on the sensing data SDT. For example, the partial area 310 may be an AOD area. An image may be always displayed in the AOD area. The partial area data controller 20 may determine whether a user looks at the display panel 300 or is expected to look at the display panel 300 based on the sensing data SDT. The brightness of the partial area 310 may be increased when it is determined that the user looks at the display panel 300 or is expected to look at the display panel 300, and may be reduced when it is determined that the user does not look at the display panel 300. The partial area data controller 20 may control the brightness of the partial area 310 by adjusting the partial image data to be displayed on the partial area 310, that is, by adjusting the pixel data value included in the partial image data in accordance with the above-described data adjustment method.

Figure 14:
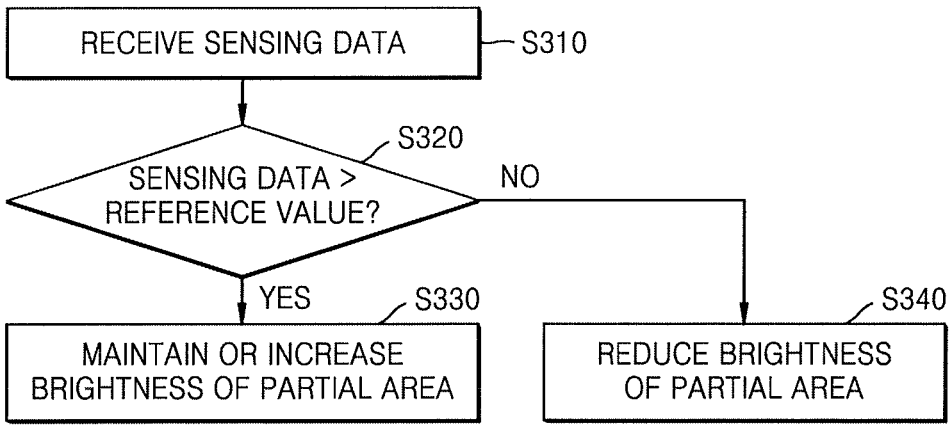
FIG. 14 illustrates a flowchart of a method of controlling brightness of a partial area according to an example embodiment.

FIG. 14 is a flowchart illustrating a method of controlling brightness of a partial area according to an example embodiment. The brightness control method of FIG. 14 may be performed by the display driving circuit 200, in detail, the partial area data controller 20 of the display system 1000*a* of FIG. 13.

Referring to FIGS. 13 and 14, the display driving circuit 200 may receive the sensing data SDT from the processor 100 or the sensor controller 410 in operation S310. The sensing data SDT may include at least one of a light sensing value, a motion sensing value, and a proximity sensing value.

The display driving circuit 200 may compare the sensing data SDT with a reference value in operation S320. When the sensing data SDT has a value greater than the reference value, the display driving circuit 200 may determine that proximity or motion of the user is sensed. The display driving circuit 200 may determine that the user looks at the display panel 300 or will look at the display panel 300. The display driving circuit 200 may maintain or increase the brightness of the partial area.

When the sensing data SDT has a value of no more than the reference value, the display driving circuit 200 may determine that the motion or proximity of the user is not sensed. The display driving circuit 200 may determine that the user does not look at the display panel 300 or will not look at the display panel 300. The display driving circuit 200 may reduce power consumption of the display system 1000*a* by reducing the brightness of the partial area. In operations S330 and S340, the display driving circuit 200 may control the brightness of the partial area by adjusting the pixel data values of the partial image data to be displayed on the partial area.

In an implementation, the display driving circuit 200 may control the brightness of the image to be displayed on the partial area 310 of the display panel 300 based on the user selection (or setup), which will now be described with reference to FIGS. 15 and 16.

Figure 15:
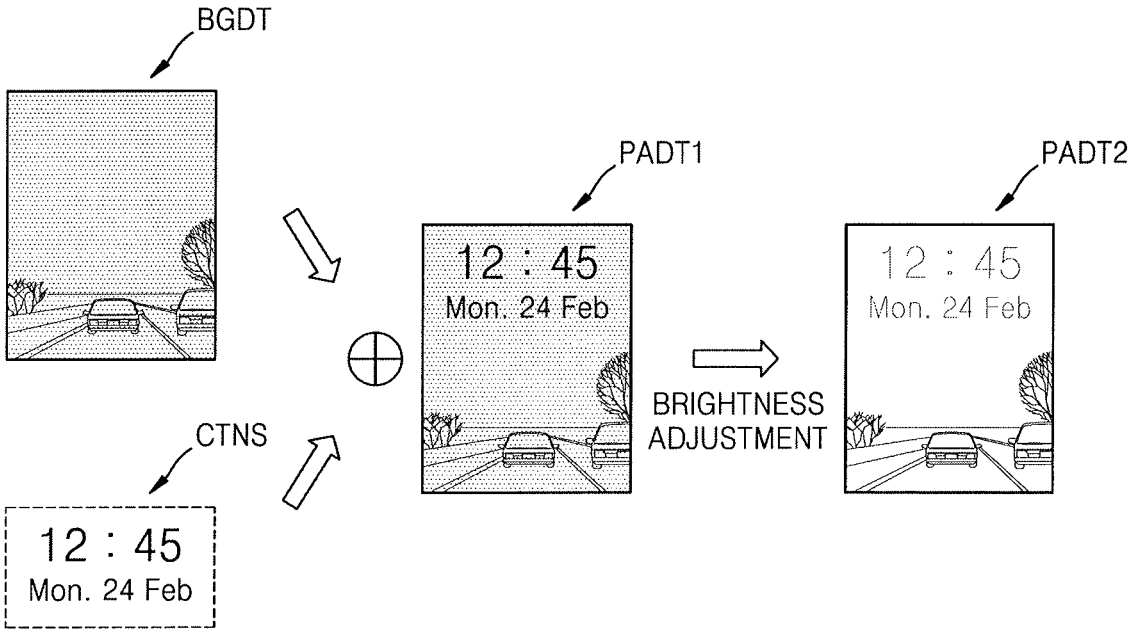
FIG. 15 illustrates a view of a method of controlling brightness of a partial area according to an example embodiment.

FIG. 15 is a view illustrating a method of controlling brightness of a partial area according to an example embodiment. The brightness control method of FIG. 15 may be performed by a control logic 220*a* of FIG. 7B.

Referring to FIGS. 7A and 15, the partial image data generator 23 may receive the background image data BGDT and the contents image data CTNS, and may generate the partial image data PADT1 to be displayed on the partial area 310 of the display panel 300.

At this time, when the user selection signal USS requests the contents image data CTNS to be more emphasized than the background image data BGDT, the partial area data controller 20 may increase the brightness of the contents image data CTNS displayed on the partial area 310 and/or reduce the brightness of the background image data BGDT by adjusting the pixel data values of the partial image data PADT1. Therefore, the partial image data PADT2 in which the contents image data CTNS is emphasized may be generated and the adjusted partial image data PADT2 may be displayed on the partial area 310 of the display panel 300.

In an example embodiment, brightness of a particular color may be increased so that the particular color is emphasized based on the user selection signal USS. For example, when the display panel 300 has the RGB structure, by adjusting data values of at least one color selected from red pixel data values, blue pixel data values, and green pixel data values based on the user selection signal USS, brightness of the at least one color may be selectively increased in the partial image data PADT1 displayed on the partial area 310.

Figure 16:
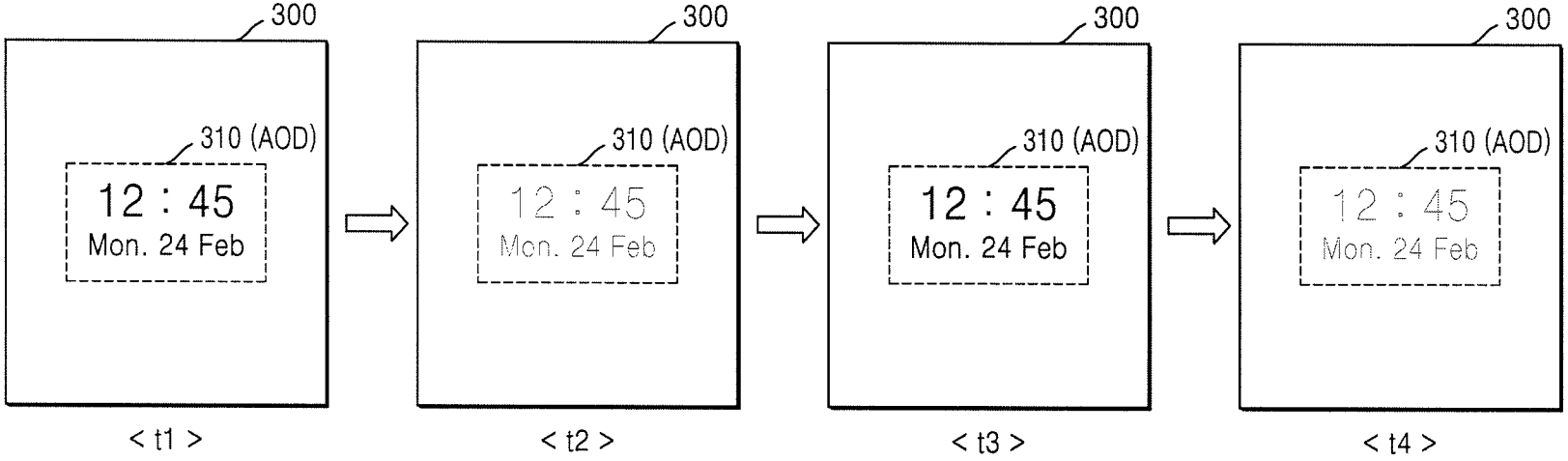
FIG. 16 illustrates a view of a method of controlling brightness of a partial area according to an example embodiment.

FIG. 16 is a view illustrating a method of controlling brightness of a partial area according to an example embodiment.

Referring to FIG. 16, the user selection signal USS may request brightness of the partial area 310 (for example, the AOD area) to be increased and reduced in accordance with time, and the partial area data controller 20 may periodically or non-periodically upscale and downscale the pixel data values of the partial image data to be displayed on the partial area 310 in order to increase and reduce the brightness of the partial area 310 in accordance with time in response to the user selection signal USS. Therefore, the brightness of the partial area 310 may be increased and reduced (for example, flickering) in accordance with time. For example, as illustrated in FIG. 16, the brightness of the partial area 310 may be high at a point in time t1 and a point in time t3 and may be low at a point in time t2 and a point in time t4.

Figure 17:
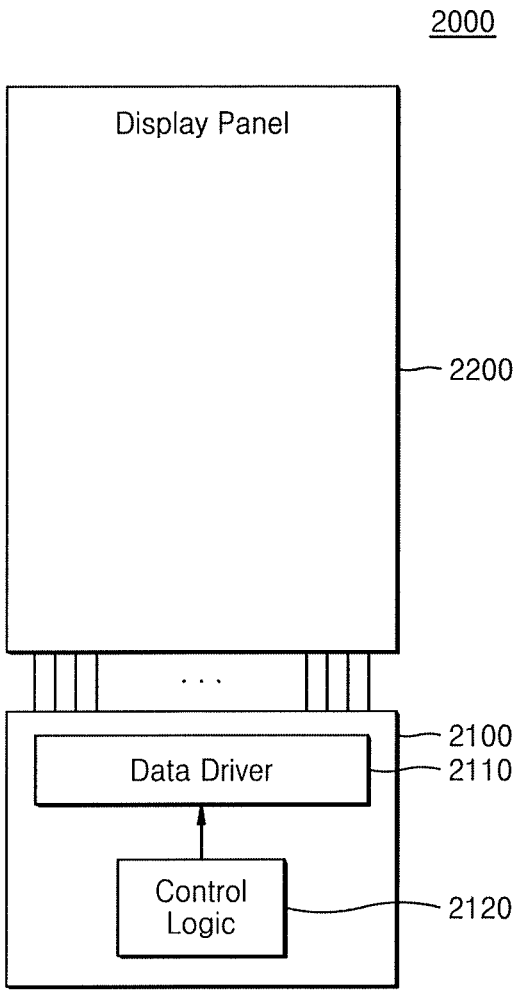
FIG. 17 illustrates a display device according to an example embodiment.

FIG. 17 illustrates a display device 2000 according to an example embodiment.

The display device 2000 of FIG. 17 including a display panel 2200 may be applied to a mobile device, for example, a smart phone or a tablet personal computer (PC).

Referring to FIG. 17, the display device 2000 may include a display driving circuit 2100 and the display panel 2200. The display driving circuit 2100 may be configured by at least one integrated circuit (IC) and may be mounted in a circuit film such as tape carrier package (TCP), a chip on film (COF), or a flexible print circuit (FPC), may be attached to the display panel 2200 by a tape automatic bonding (TAB) method, or may be mounted on a non-display area of the display panel 2200 by a chip on glass method.

The display driving circuit 2100 may include a data driver 2110 and a control logic 2120. In an example embodiment, the display driving circuit 2100 may further include a gate driver. In an example embodiment, the gate driver and an emission control driver may be mounted in the display panel 2200.

The partial area data controller 20 described with reference to FIG. 1 may be provided in the control logic 2120. The partial area data controller 20 may adjust brightness of a partial area of the display panel 2200 by a data adjustment method.

The data driver 2110 may convert image data received from the control logic 2120 into image signals and may provide the image signals to the display panel 2200. In the AOD operation mode, the data driver 2110 may receive partial image data with adjusted pixel data values from the partial area data controller 20, may convert the received partial image data into the image signals, and may display the image signals in the partial area of the display panel 2200.

As described above, embodiments may provide a display driving circuit that provides improved picture quality and operates by low power.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display driving circuit for driving an organic light emitting diode (OLED) display panel, the display driving circuit comprising:

a control logic that adjusts brightness of light emitted by pixel circuits in a first partial area of the display panel by adjusting pixel data values included in partial image data to be displayed in the first partial area of the display panel based on received brightness control information supplied from outside the display driving circuit; and a data driver that generates image signals by digital-analog conversion of pixel data values provided from the control logic, the data driver providing the image signals to pixel circuits of the display panel, wherein:

brightness of light emitted by pixel circuits in a second partial area of the display panel is increased when an operation mode of the display driving circuit changes from a first operation mode to a second operation mode, the adjusted pixel data values are adjusted in the second operation mode so that the first partial area has the same brightness in the first operation mode and the second operation mode, the control logic determines a scaling value for adjusting the pixel data values based on a position of the first partial area on the display panel and the brightness control information, and the control logic determines the scaling value by determining a reference scaling value based on the brightness control information and adjusting the reference scaling value based on a loading effect in accordance with the position of the first partial area on the display panel.

2. The display driving circuit as claimed in claim 1, wherein:

the control logic includes a lookup table for storing reference scaling values corresponding to various brightness set values and offset values by pixel, and the control logic adjusts the pixel data values based on the reference scaling value and an offset value that are selected from the lookup table based on the brightness control information.

3. The display driving circuit as claimed in claim 2, wherein:

the control logic adjusts the reference scaling value to an adjusted reference scaling value based on an adjustment value determined in accordance with the position of the first partial area on the display panel, and the control logic adjusts the pixel data values based on the adjusted reference scaling value and the pixel data values.

4. The display driving circuit as claimed in claim 1, wherein:

the brightness control information includes a brightness set value that represents set brightness of the display panel, and a logic circuit adjusts the pixel data values when the brightness set value changes based on the changed brightness set value.

5. The display driving circuit as claimed in claim 4, wherein:

the brightness set value is changed so that the brightness of the second partial area is increased when the operation mode of the display driving circuit changes from the first operation mode to the second operation mode, and the logic circuit adjusts the pixel data values based on the changed brightness set value in the second operation mode.

6. The display driving circuit as claimed in claim 1, wherein:

the brightness control information includes sensing data from an external sensor, and the control logic adjusts the pixel data values so that brightness of the first partial area is reduced when the sensing data has a value of no more than a reference value.

7. The display driving circuit as claimed in claim 1, wherein:

the brightness control information includes a selection signal for selecting, as a selected image, one of a background image and a contents image that are displayed in the first partial area, and the control logic increases pixel data values corresponding to sub-pixels for displaying the selected image in the first partial area so that brightness of the selected image increases.

8. The display driving circuit as claimed in claim 1, wherein the brightness control information includes a user selection signal for representing that brightness of the first partial area periodically changes.

9. The display driving circuit as claimed in claim 1, wherein:

the brightness control information includes a selection signal for selecting at least one of a plurality of colors respectively represented by first pixels, and the control logic increases or reduces a pixel data value corresponding to a color selected based on the selection signal.

10. The display driving circuit as claimed in claim 1, wherein the control logic includes:

a parameter determiner that determines the reference scaling value for the first partial area based on the brightness control information; and a brightness controller that adjusts the pixel data values by applying the reference scaling value to the pixel data values.

11. The display driving circuit as claimed in claim 10, wherein the control logic further includes an image generator that generates partial image data to be displayed in the first partial area.

12. The display driving circuit as claimed in claim 11, wherein the image generator generates the partial image data by combining contents image data that changes with time with a background image received from an external processor.

13. A display device, comprising:

an organic light emitting diode (OLED) display panel including a first partial area and a second partial area; and a display driving circuit that adjusts brightness of light emitted by pixel circuits by adjusting partial image data to be displayed in the first partial area based on brightness control information for changing brightness of the display panel, and controls brightness of the first partial area by displaying the adjusted partial image data in the first partial area when an operation mode changes from a first operation mode to a second operation mode, wherein:

brightness of light emitted by pixel circuits in the second partial area is increased when the operation mode of the display driving circuit changes from the first operation mode to the second operation mode, the adjusted partial image data are adjusted in the second operation mode so that the first partial area has the same brightness in the first operation mode and the second operation mode, the display driving circuit detects an amount of change in brightness of the display panel when the operation mode changes from the first operation mode to the second operation mode based on the brightness control information, and determines a scaling value for adjusting the image data so that the brightness of the first partial area is maintained to be the same in the first operation mode and the second operation mode based on the amount of change in brightness, and the display driving circuit determines the scaling value based on a loading effect based on the brightness control information, a position of the first partial area on the display panel, and a size of the first partial area.

14. The display device as claimed in claim 13, wherein:

the display panel includes a plurality of pixels each including an OLED, and the display driving circuit controls brightness of the display panel by adjusting an emission time of the OLED based on the brightness control information, and adjusts the partial image data so that brightness of the first partial area is maintained based on a fluctuation rate of the emission time when the operation mode changes from the first operation mode to the second operation mode.

15. A method of operating a display driving circuit for controlling brightness of a first partial area and a second partial area of an organic light emitting diode (OLED) display panel, the method comprising:

receiving brightness control information from a processor;

adjusting brightness of light emitted by pixel circuits in the first partial area by adjusting pixel data values corresponding to the first partial area based on the brightness control information; and driving the first partial area based on the adjusted pixel data values, wherein:

brightness of light emitted by pixel circuits in the second partial area is increased when an operation mode of the display driving circuit changes from a first operation mode to a second operation mode, and the adjusted pixel data values are adjusted in the second operation mode so that the first partial area has the same brightness in the first operation mode and the second operation mode, wherein the adjusting of the pixel data values in the first partial area includes:

determining a reference scaling value based on a brightness set value included in the brightness control information;

correcting the reference scaling value to a corrected reference scaling value based on a loading effect in accordance with a position of the first partial area on the display panel;

obtaining offset values by pixel; and adjusting pixel data values based on the corrected reference scaling value and offset values.

* * * * *